US008177734B2

(12) United States Patent
Vess

(10) Patent No.: US 8,177,734 B2
(45) Date of Patent: May 15, 2012

(54) PORTABLE CONTROLLER UNIT FOR A COMPRESSION DEVICE

(75) Inventor: Mark A. Vess, Hanson, MA (US)

(73) Assignee: Tyco Healthcare Group LP, Mansfield, MA (US)

( * ) Notice: Subject to any disclaimer, the term of this patent is extended or adjusted under 35 U.S.C. 154(b) by 851 days.

(21) Appl. No.: 12/241,670

(22) Filed: Sep. 30, 2008

(65) Prior Publication Data

US 2010/0081974 A1 Apr. 1, 2010

(51) Int. Cl.
*A61H 23/00* (2006.01)

(52) U.S. Cl. ..... 601/150; 601/149; 601/152

(58) Field of Classification Search ..... 601/148–152, 601/DIG. 20; 602/13; 128/DIG. 20
See application file for complete search history.

(56) References Cited

U.S. PATENT DOCUMENTS

| | | | |
|---|---|---|---|
| 3,288,132 | A | 11/1966 | Meredith |
| 3,699,945 | A | 10/1972 | Hanafin |
| 3,826,249 | A | 7/1974 | Lee et al. |
| 4,091,804 | A | 5/1978 | Hasty |
| 4,372,297 | A | 2/1983 | Perlin |
| D269,905 | S | 7/1983 | Tamm |
| 4,402,312 | A | 9/1983 | Villari et al. |
| 4,524,458 | A | 6/1985 | Pongrass et al. |
| 4,579,555 | A | 4/1986 | Russo |
| 4,702,235 | A | 10/1987 | Hong |
| 4,804,208 | A | 2/1989 | Dye |
| 5,135,469 | A | 8/1992 | Castillo |
| 5,152,302 | A | 10/1992 | Fareed |
| 1,928,992 | A | 10/1993 | Clark et al. |
| 5,310,400 | A | 5/1994 | Rogers et al. |
| 5,312,431 | A | 5/1994 | McEwen |
| 5,342,285 | A | 8/1994 | Dye |
| 5,403,265 | A | 4/1995 | Berguer et al. |
| 5,437,615 | A | 8/1995 | Pekar et al. |
| 5,478,119 | A | 12/1995 | Dye |
| 5,546,955 | A | 8/1996 | Wilk |
| 5,578,055 | A | 11/1996 | McEwen |
| 5,626,556 | A | 5/1997 | Tobler et al. |
| 5,641,322 | A | 6/1997 | Silver et al. |
| 5,725,485 | A | 3/1998 | Ribando et al. |

(Continued)

FOREIGN PATENT DOCUMENTS

WO 2007085828 A1 8/2007

(Continued)

OTHER PUBLICATIONS

European Search Report regarding related application serial No. EP 09170462.7 dated Feb. 10, 2010, 6 pgs.

(Continued)

*Primary Examiner* — Quang D Thanh
(74) *Attorney, Agent, or Firm* — Thomas M. Johnston, Esq.

(57) ABSTRACT

A portable controller unit for delivering pressurized air to a compression device does not require the use of tubing to make internal or external connections. The controller unit includes a molded, one-piece manifold base on which an air compressor and a valve mechanism are mounted. The manifold base includes a plenum formed inside the base during molding of the base and a connector component formed during molding of the base for releasably securing the base to the compression device. The plenum fluidly connects the air compressor to the valve mechanism. The plenum extends through the connector component and fluidly connects the connector to the valve mechanism so that when the base is secured to the compression device, air can be delivered from the air compressor through the connector component to the compression device.

16 Claims, 7 Drawing Sheets

U.S. PATENT DOCUMENTS

| | | | |
|---|---|---|---|
| 5,795,312 | A | 8/1998 | Dye |
| 5,827,243 | A | 10/1998 | Palestrant |
| 5,891,065 | A | 4/1999 | Cariapa et al. |
| 6,080,120 | A | 6/2000 | Sandman et al. |
| 6,102,252 | A | 8/2000 | Overman et al. |
| 6,155,263 | A | 12/2000 | Weaver |
| 6,203,510 | B1 | 3/2001 | Takeuchi et al. |
| 6,290,662 | B1 | 9/2001 | Morris et al. |
| 6,375,633 | B1 | 4/2002 | Endress et al. |
| 6,428,492 | B2 | 8/2002 | Lloyd |
| 6,554,785 | B1 | 4/2003 | Sroufe et al. |
| 6,579,252 | B2 | 6/2003 | Lloyd et al. |
| 6,585,669 | B2 | 7/2003 | Manor et al. |
| 6,589,194 | B1 | 7/2003 | Calderon et al. |
| 6,676,614 | B1 | 1/2004 | Hansen et al. |
| 6,685,661 | B2 | 2/2004 | Peled |
| 6,966,884 | B2 | 11/2005 | Waldridge et al. |
| 7,063,676 | B2 | 6/2006 | Barak et al. |
| 7,120,955 | B2 | 10/2006 | Wang |
| 7,127,762 | B1 | 10/2006 | Lau |
| 7,186,245 | B1 | 3/2007 | Cheng et al. |
| 7,270,642 | B2 | 9/2007 | Ouchene et al. |
| 7,284,291 | B2 | 10/2007 | Wang |
| 7,316,658 | B2 | 1/2008 | Gagne |
| 7,354,411 | B2 | 4/2008 | Perry et al. |
| 7,376,994 | B2 | 5/2008 | Wu |
| 7,384,425 | B2 | 6/2008 | McEwen |
| 7,442,175 | B2 | 10/2008 | Meyer et al. |
| 2002/0022791 | A1 | 2/2002 | Morris et al. |
| 2002/0115949 | A1 | 8/2002 | Kuslich et al. |
| 2003/0078674 | A1 | 4/2003 | Phillips |
| 2003/0181990 | A1 | 9/2003 | Phillips |
| 2004/0199090 | A1 | 10/2004 | Sanders et al. |
| 2005/0184264 | A1 | 8/2005 | Tesluk et al. |
| 2005/0187503 | A1 | 8/2005 | Tordella et al. |
| 2006/0258964 | A1 | 11/2006 | Biondo et al. |
| 2006/0287621 | A1 | 12/2006 | Atkinson et al. |
| 2007/0038167 | A1 | 2/2007 | Tabron et al. |
| 2007/0049852 | A1 | 3/2007 | Linnane et al. |
| 2007/0049853 | A1 | 3/2007 | Adams et al. |
| 2007/0055188 | A1 | 3/2007 | Avni et al. |
| 2007/0088239 | A1 | 4/2007 | Roth et al. |
| 2007/0135743 | A1 | 6/2007 | Meyer |
| 2007/0249976 | A1 | 10/2007 | Tucker et al. |
| 2007/0249977 | A1 | 10/2007 | Bonnefin et al. |
| 2008/0177159 | A1 | 7/2008 | Gavriely |
| 2010/0081977 | A1 | 4/2010 | Vess |

FOREIGN PATENT DOCUMENTS

| | | | |
|---|---|---|---|
| WO | 2008055304 | A1 | 5/2008 |
| WO | 2008084225 | A1 | 7/2008 |

OTHER PUBLICATIONS

Office action issued Aug. 17, 2011 regarding U.S. Appl. No. 12/241,936. 12 pgs.

PORTABLE CONTROLLER UNIT FOR A COMPRESSION DEVICE

FIELD OF THE INVENTION

The present invention generally relates to a portable controller unit for a compression device, particularly of the type use to prevent or treat medical conditions such as deep vein thrombosis.

BACKGROUND OF THE INVENTION

A major concern for immobile patients and like persons are medical conditions that form clots in the blood, such as, deep vein thrombosis (DVT) and peripheral edema. Such patients and persons include those undergoing surgery, anesthesia, extended periods of bed rest, etc. These blood clotting conditions generally occur in the deep veins of the lower extremities and/or pelvis. These veins, such as the iliac, femoral, popiteal and tibial return, deoxygenated blood to the heart. For example, when blood circulation in these veins is retarded due to illness, injury or inactivity, there is a tendency for blood to accumulate or pool. A static pool of blood may lead to the formation of a blood clot. A major risk associated with this condition is interference with cardiovascular circulation. Most seriously, a fragment of the blood clot can break loose and migrate. A pulmonary emboli can form from the fragment potentially blocking a main pulmonary artery, which may be life threatening. The current invention can also be applied to the treatment of other conditions, such as lymphedema.

The conditions and resulting risks associated with patient immobility may be controlled or alleviated by applying intermittent pressure to a patient's limb, such as, for example, a leg to assist in blood circulation. For example, sequential compression devices have been used, such as the device disclosed in U.S. Pat. No. 4,091,804 to Hasty. Sequential compression devices are typically constructed of two sheets of material secured together at the seams to define one or more fluid impervious bladders, which are connected to a source of pressure for applying sequential pressure around a patient's body parts for improving blood return to the heart. The inflatable sections are covered with a laminate to improve durability, patient comfort, and to protect against puncture. As part of the compression device, the two sheets are structurally designed to withstand a changing pressure over time under repeated use. Medical tubing is used to make connection of the source of pressure to the usually several bladders of the compression device. The source of air pressure is an air compressor most often located remotely from the patient.

SUMMARY OF THE INVENTION

In one aspect of the present invention, a portable controller unit for delivering pressurized air to a compression device of the type for applying compression to a body part of a wearer generally comprises an air compressor and a valve mechanism. A molded, one-piece manifold base on which the air compressor and the valve mechanism are mounted includes a plenum formed inside the base during molding of the base and a connector component formed during molding of the base for releasably securing the base to the compression device. The plenum fluidly connecting the air compressor to the valve mechanism extends through the connector component and fluidly connects the connector to the valve mechanism so that when the base is secured to the compression device, air can be delivered from the air compressor through the connector component to the compression device.

In another aspect of the present invention, a method of making a portable controller unit for delivering pressurized air to compression device of the type for applying compression to a body part of a wearer generally comprises molding a one-piece manifold base having a connector component for releasably securing the base to the compression device, and a plenum inside the base extending through the connector component. An air compressor is mounted on the manifold base adapted for fluid communication with the plenum. A valve mechanism mounted on the base is adapted for fluid communication with the plenum.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
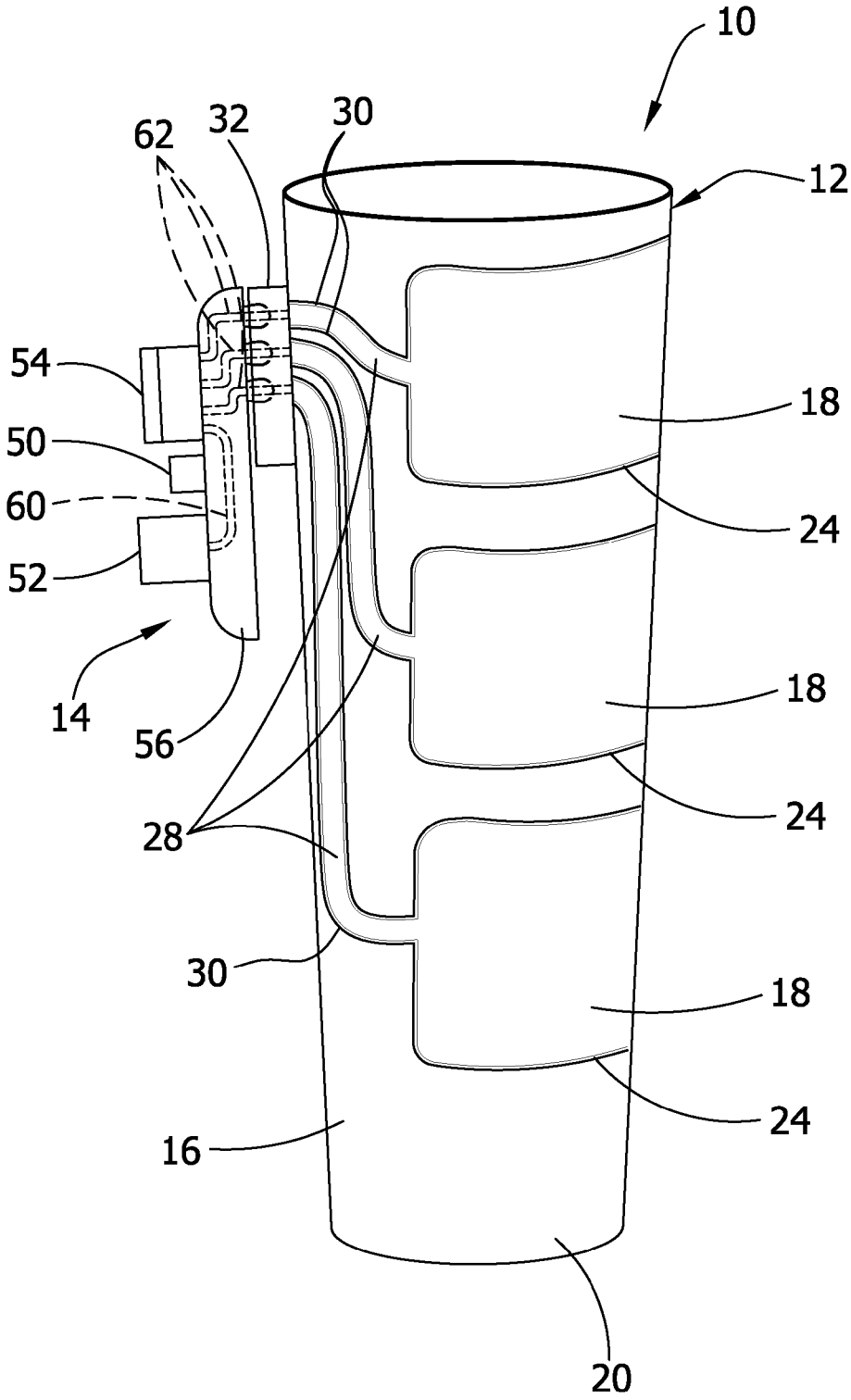
FIG. 1 is a perspective of a compression device assembly in a closed, wrapped configuration.

Referring now to the drawings and in particular to FIG. 1, a compression device assembly for applying compression therapy to a body part of a wearer is generally indicated 10. The compression device assembly includes a compression device, generally indicated at 12, and a portable controller unit, generally indicated at 14, mounted on the compression device.

Figure 2:
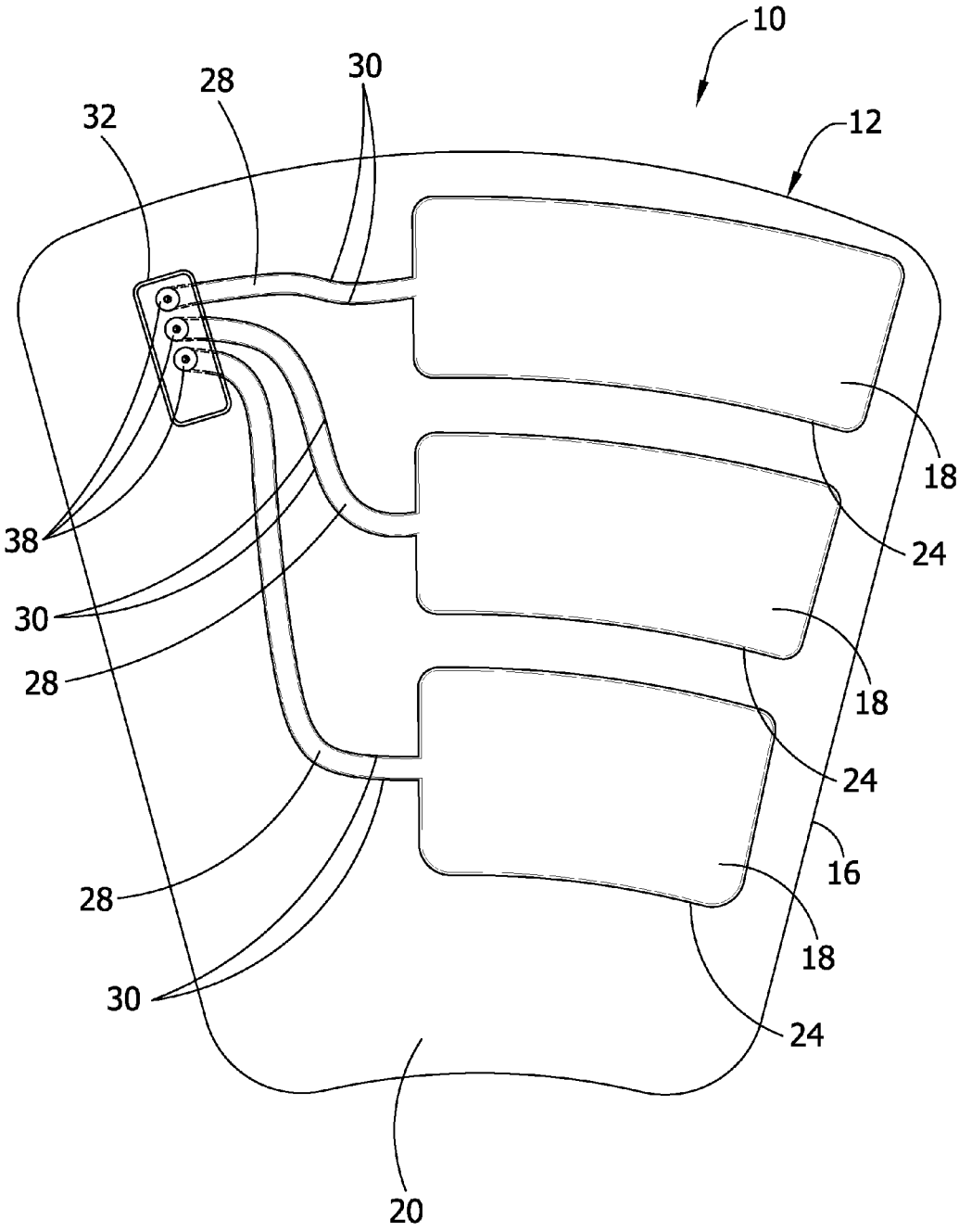
FIG. 2 is a plan view of a compression device of the compression device assembly in an open, unwrapped configuration.
Figure 3:
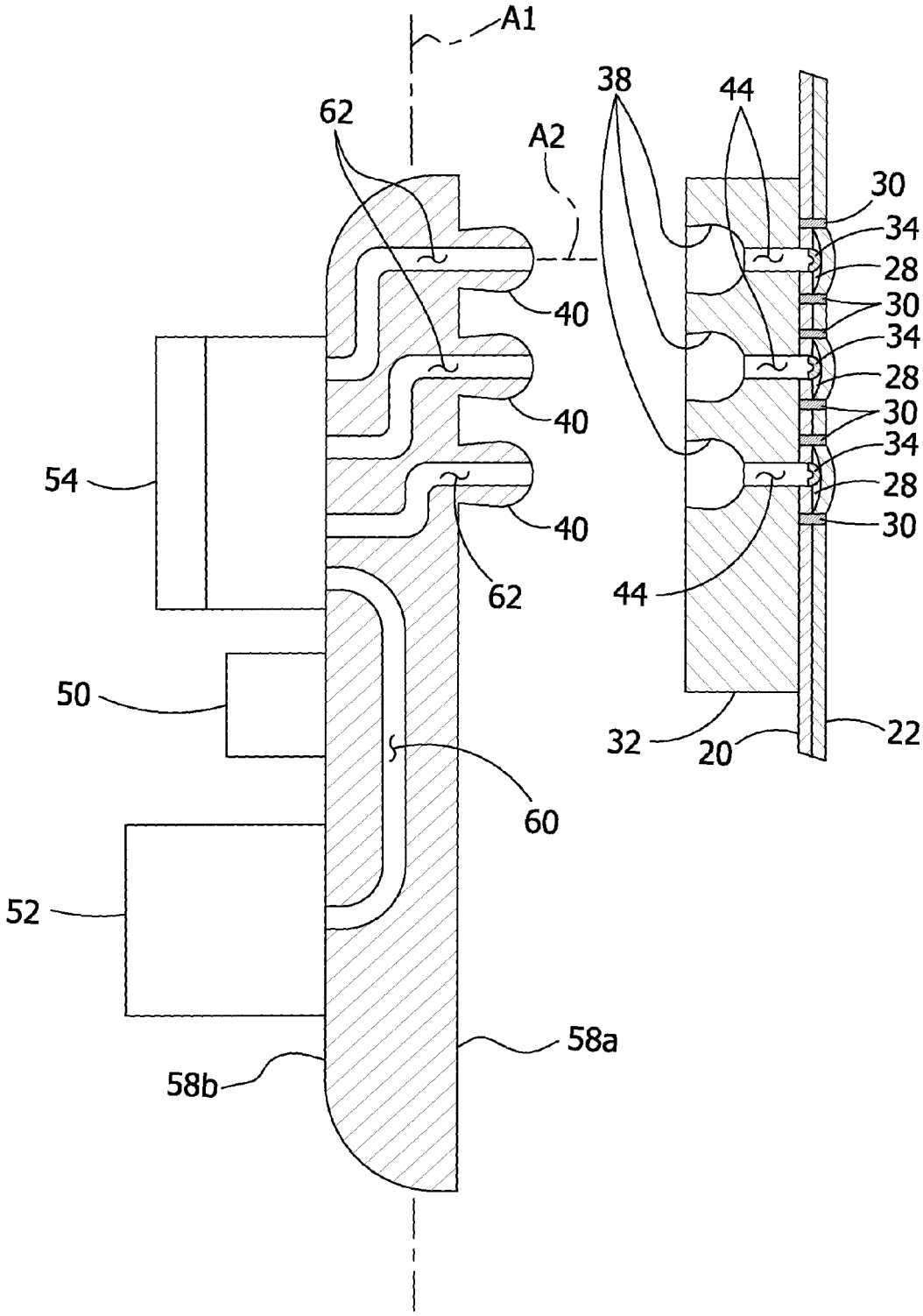
FIG. 3 is an enlarged, fragmentary section of the compression device assembly showing a portable controller unit exploded from a mount.

Referring to FIGS. 1-3, the compression device 12 of the illustrated embodiment is sized and shaped to be wrapped around a leg of a wearer. The compression device 12 includes an inflatable member 16 having three spaced apart inflatable bladders 18. The number and/or configuration of bladders may be other than shown in the illustrated embodiment. The inflatable member 16 comprises opposing inner and outer bladder layers 20, 22, respectively, secured to one another along upper, intermediate and lower bladder sealing lines 24. As used herein, the terms "inner" and "outer" refer to relative positions with respect to the wearer's leg when the device 12 is wrapped around the leg. The sealing lines 24 together with portions of the bladder layers 20, 22 within the perimeters of the lines define respective inflatable bladders 18 that are capable of retaining pressurized air. In one embodiment, each bladder layer 20, 22 is integrally formed as a single sheet of material. For example, each bladder layer 20, 22 may be formed from a single sheet of air impermeable material, such as PVC, or may be a laminated material. Further, the bladder layers 20, 22 may be welded to one another along the bladder sealing lines 24, although other ways of forming the bladder lines and the inflatable bladders are within the scope of the invention. Although not illustrated, the compression device 12 may include an inner layer or liner for contacting the skin of the wearer and an outer layer forming the exterior surface of the device. Other configurations are within the scope of the present invention.

Referring to FIGS. 1-6, conduits 28 in fluid communication with the respective inflatable bladders 18 extend from the inflatable bladders to a mount 32 (broadly, "a conduit terminal") on which the portable controller unit 14 (or "air compressor unit") is mounted, as will explained in detail below. The conduits 28 are used to deliver pressurized air from the controller unit 14 to the inflatable bladders 18 during use. Each conduit 28 is formed by a pair of spaced apart, generally opposing conduit sealing lines 30 that secure the bladder layers 20, 22 to one another. Each pair of conduit lines 30 and portions of the bladder layers 20, 22 between the pair of lines define one of the conduits 28. As with the bladder sealing lines 24, the bladder layers 20, 22 may be welded to one another along the conduit sealing lines 30. Further, as in the illustrated embodiment, each bladder 18 and associated conduit 28 may be formed by a single, continuous line. For example and without being limiting, a single welding operation may form a continuous sealing line that includes the bladder sealing line 24 and the pair of conduit sealing lines 30 of one of the bladders 18 and its associated conduit 28.

Referring to FIGS. 3-6, a spacer 34 is received in each conduit 28 for maintaining the conduit open along its length so that the conduit remains in fluid communication with the controller unit 14 during use. Each spacer 34 is generally elongate and generally flexible along its length so that the spacer is able to conform to the path of the conduit 28. As shown best in FIG. 5, each spacer 34 has a generally U-shaped cross section and a height extending between the opposing bladder layers 20, 22 in the conduit. Each spacer 34 is substantially incompressible along its height, or at least will not completely collapse under normal conditions. Through this configuration, the conduits 28 remain open and the bladders 18 remain in fluid communication with the controller unit 14 despite any compressive forces being applied to the device 12 (e.g., the weight of the wearer's leg) that may close or otherwise impede fluid flow between the controller unit and one or more of the inflatable bladders. In one example, each spacer 34 is constructed of PVC or silicone, including extrudable silicone, and may be formed by extrusion or from stock.

Referring to FIGS. 1-3A, the mount 32 on which the portable controller unit 14 is mounted is secured to an exterior surface of the outer bladder layer 20. The mount 32 includes internal female connector components 38 for receiving mateable male connector components 40 of the portable controller unit 14 to releasably mount the controller unit on the compression device 12. It is understood that the mount 32 may include male connection components for being received in mateable female connector components of the portable controller unit 14 within the scope of the invention. In the illustrated embodiment, the male connection components 40 are releasably retained in the female connection components 38 by snap-fit engagement. The male connector components 40 have a slightly bulbous shape and the female connector components 38 ("receptacles") have a corresponding shape. The widest part of the male connector component 40 is wider than a mouth of the female connector component 38 so that the male component and/or female component are deformed as the male component enters the female connector component. Once the male connector component 40 is inserted far enough into the female connector component 38, it reaches a wider portion of the female connector component and "snaps" back toward its original shape. It will be appreciated that the connector components 38, 40 thereafter resist separation. However, upon application of sufficient force, the connector components 38, 40 can be disconnected. Other ways of releasably mounting the portable controller unit 14 on the compression device 12, including mateable snap-fit components, are within the scope of the invention.

Figure 3A:
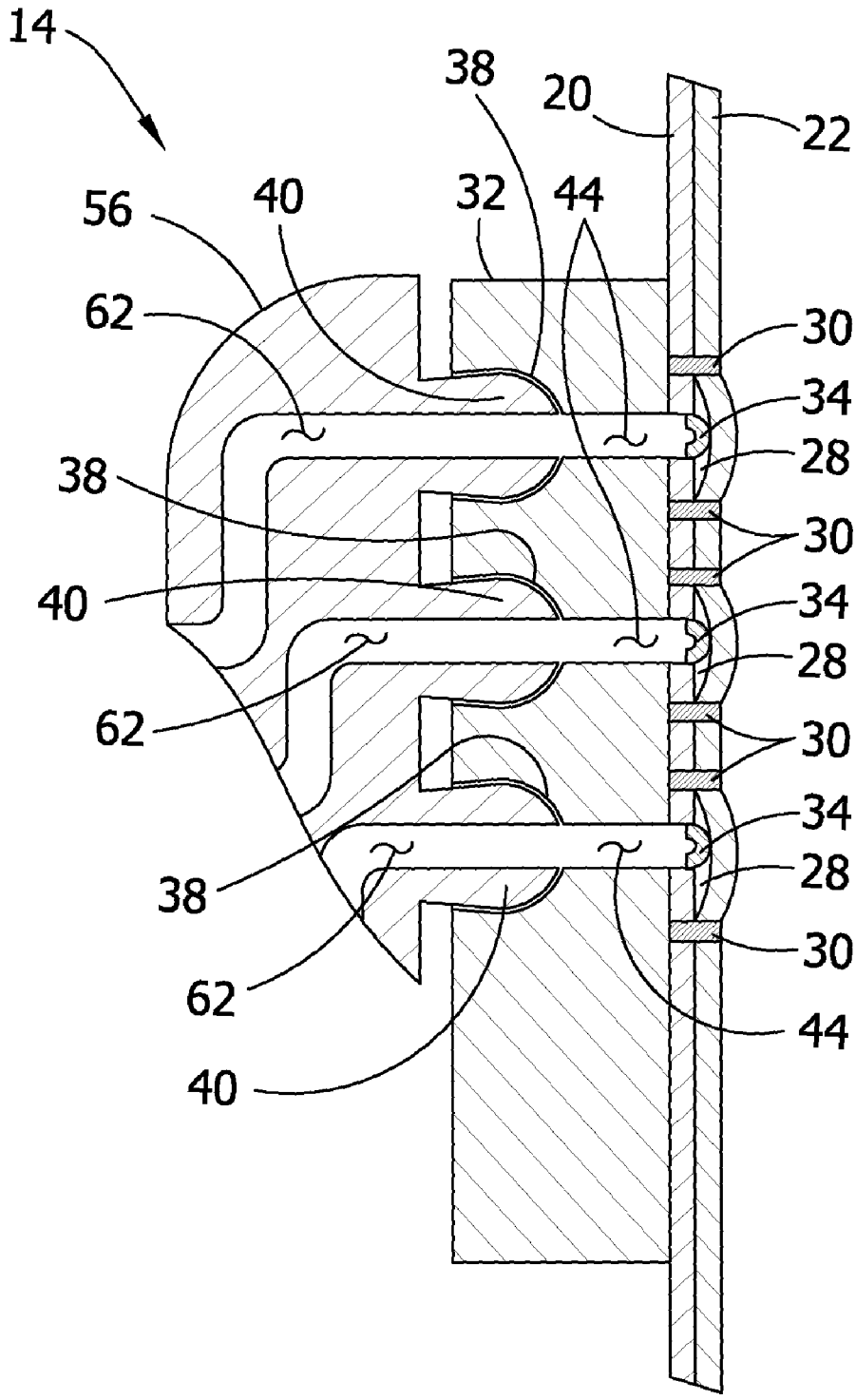
FIG. 3A is an enlarged, fragmentary view of FIG. 3 with the portable controller unit connected to the mount.
Figure 4:
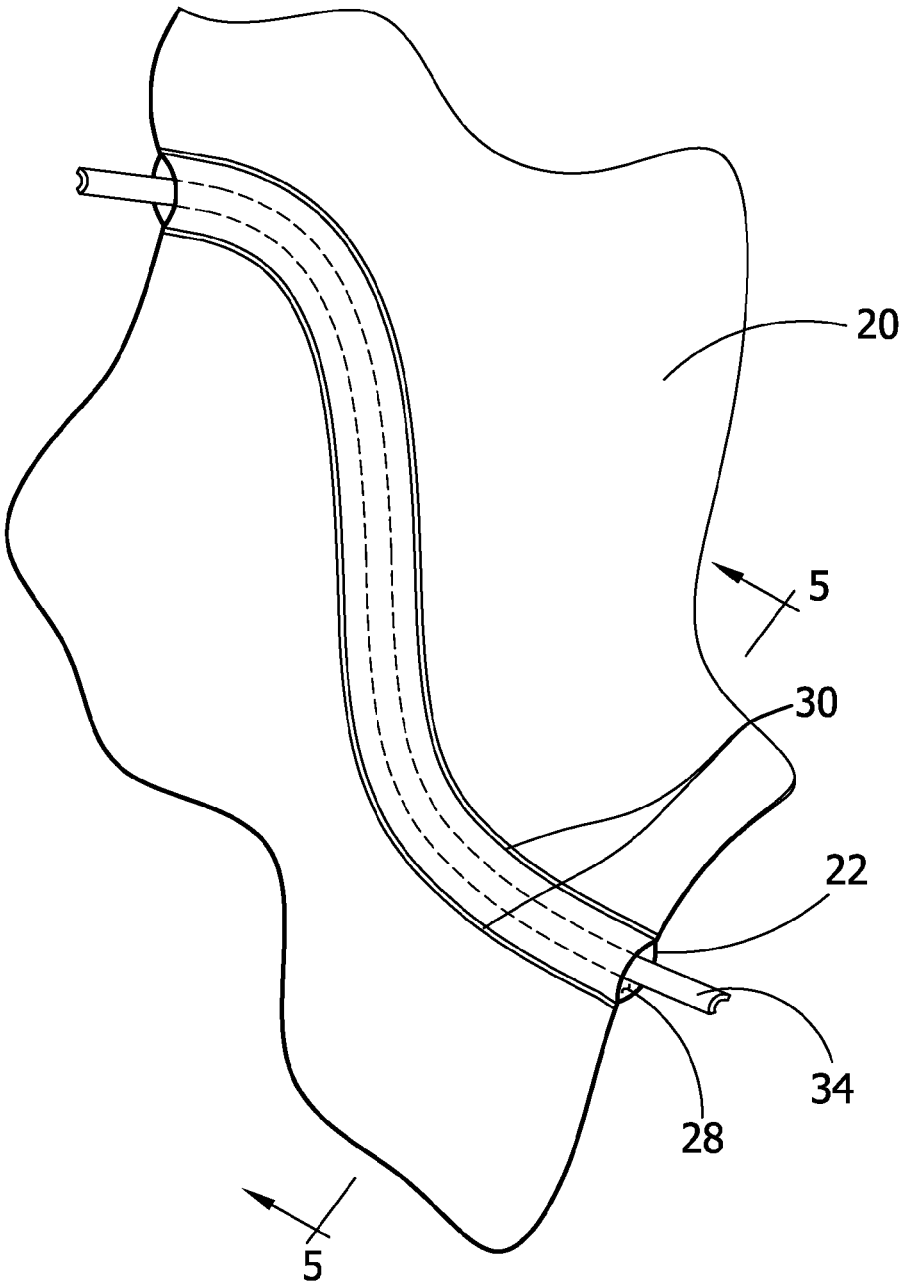
FIG. 4 is an enlarged, fragmentary view of a portion of the compression device.
Figure 5:
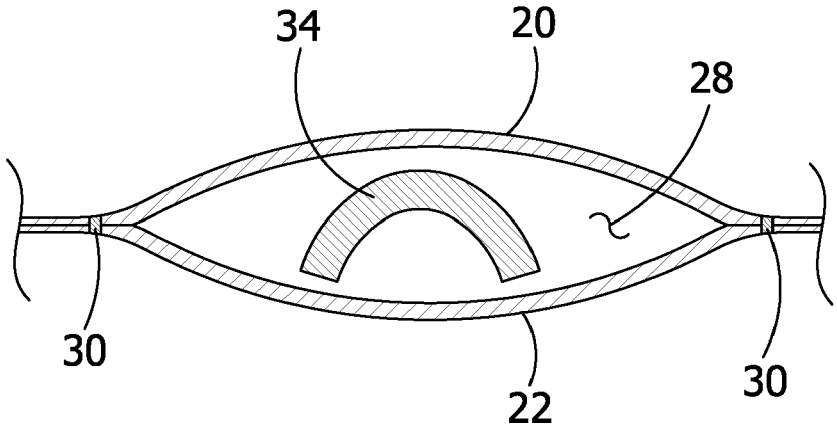
FIG. 5 is an enlarged section of the compression device taken along the line 5-5 in FIG. 4.
Figure 6:
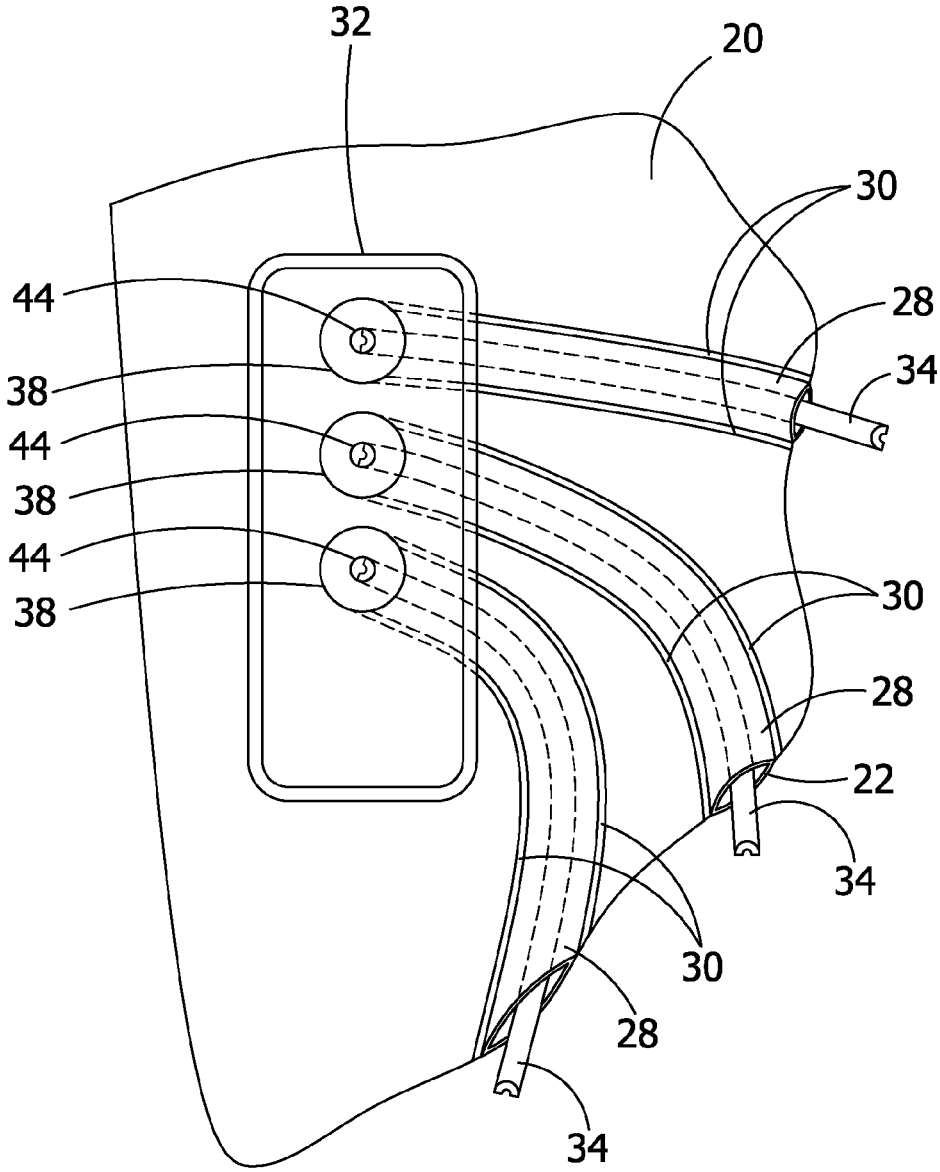
FIG. 6 is an enlarged, fragmentary view of the compression device.

Referring to FIGS. 3 and 3A, each female connector component 38 of the mount 32 is fluidly connected to one of the conduits 28 via an inlet passage 44 inside the mount. In one example, the mount 32, including the female connector components 38 and the inlet passages 44, is molded as a one-piece unit. Other ways of forming the mount 32 are within the scope of the invention. The mount 32 is secured to the inner and outer bladder layers 20, 22 by heat welding (e.g., radiofrequency (RF) welding), adhesive, mechanical connectors or in other ways so that the inlet passages 44 in the mount are in sealed, fluid communication with the respective bladder conduits 28. For example and without being limiting, in one method the mount 32 is placed in an RF welding die together with a sheet that will become the inner bladder layer 20, and the sheet is welded to the mount 32 around the inlet passage 44. The outer bladder layer 22 and spacers 34 (one for each conduit 28 to be formed) are next placed in the welding die. A second weld is formed connecting the inner and outer bladder layers 20, 22 together and connecting both layers to the mount 32 from each inlet passage 44 to the periphery of the mount, thereby forming a small section of the conduit 28. A U-shaped die member (not shown) is used for this procedure so that the small section of the conduit 28 is left open at the periphery of the mount 32. A third welding step joins the inner and outer bladder layers 20, 22 together to form the remainder of each conduit 28, as well as the bladders 18. The spacers 34 are encapsulated in the conduits 28 in the third welding step. Two different welding steps are used to form the conduits 28 because of the difference in thickness of material when the mount 32 is present in the weld line, versus when the mount is not part of the weld. However it is envisioned that the conduits 28 could be formed in a single step with a properly tuned weld die.

Referring to FIG. 1, the portable controller unit 14 includes a controller 50 electrically connected to an air compressor 52 and a valve mechanism 54. Each of the components 50, 52, 54 is mounted on a manifold base 56 (broadly, a base). As explained below, the male connection components 40 extend outward from the manifold base 56. More specifically, the male connection components 40 extend outward from a first face 58*a* (FIG. 3) of the base 56 and the controller 50, air compressor 52 and valve mechanism 54 are mounted on an opposite second face 58*b* (FIG. 3) of the base. In the illustrated embodiment, a longitudinal axis A1 of the base 56 is generally orthogonal to axes A2 (only one is illustrated) of the connection components 40. The controller 50 may be a microprocessor that communicates with the air compressor 52 and the valve mechanism 54 during operation. The valve mechanism 54 may comprise a plurality of valves (e.g., solenoid valves) that are controlled by the microprocessor. Although not illustrated in the drawings, the controller unit may include a rechargeable, portable power source, such as a battery for supplying power to the controller 50, the air compressor, 52 and the valve mechanism 54. The operation of the portable controller unit 14 may operate generally in the same manner as taught in the art.

Referring to FIGS. 1 and 3, the manifold base 56 includes a single internal inlet plenum 60 and a plurality of internal outlet plenums 62 extending through the male connector components 40. The inlet plenum 60 fluidly connects the air compressor 52 and the valve mechanism 54. The inlet plenum 60 extends from the second face 58*b* of the manifold base 56 at a first location to a second location on the second face. The air compressor 52 is mounted on the second face 58*b* of the base 56 in fluid communication with the inlet plenum 60 at the first location. The outlet plenums 62 fluidly connect the valve mechanism 54 and the male connector components 40. The outlet plenums 62 extend through the second face 58*b* of the base 56 at third location and extend axially through the male connector components 40 to fluidly connect the valve mechanism 54 to the respective conduits 28 and the respective bladders 18. The valve mechanism 54 is mounted on the second face 58*b* of the base 56 in fluid communication with both the inlet plenum 62 at the second location and the outlet plenums 62 at the third locations. In one example, the manifold base 56, including the inlet plenum 60, the outlet plenums 62 and the male connector components 40, is molded as a single, integral unit. For example, the base 56 and the male components 40 may be formed from a resilient polymeric material. It is understood that the base 56 may be formed in other ways without departing from the scope of the present invention. The portable controller unit 14 may also include a cover (not shown) detachably secured to the manifold base 56 to enclose the controller 50, the air compressor 52 and the valve mechanism 54.

In an exemplary use, the compression device assembly 10 is wrapped around a limb, e.g., a leg, of a patient. Mateable fasteners, such as hook and loop fasteners (not shown), that are adjacent to opposite lateral edges of the compression device 12 may be used to releasably secure the compression device to the wearer's limb, as is generally known in the art. Before or after the compression device 12 is secured to the wearer's limb, the portable controller unit 14 is mounted on the device by inserting the male connection components 40 into the respective female connection components 38 in the mount 32. As explained above, the male connection components 38 are retained in the female connection components by snap-fit engagement. With the controller unit 14 mounted on the device 12, the controller unit is in fluid communication with the inflatable bladders 18. The controller 50 can be activated to begin compression therapy, whereby the air compressor 52 delivers pressurized air via the inlet plenum 60 in the manifold base 56 to the valve mechanism 54, which diverts the air into one of the three outlet plenums 62 and into the appropriate bladder 18 via one of the conduits 28. The portable controller unit 14 can be detached from the compression 12 by simply pulling the base 56 away from the mount 32 so that the male connection components 40 disengage the female connection components 38 in the mount 32. It will be appreciated that separate tubing for delivering air is eliminated in the illustrated embodiment. It is envisioned that the compression device 12 may be disposable and constructed for one-time use. Thus, the portable controller unit 14 having a rechargeable power source can be reused and mounted on another compression device 12 of the same type.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A portable controller unit for delivering pressurized air to a compression device of the type for applying compression to a body part of a wearer, the portable controller unit comprising:

an air compressor;

a valve mechanism;

a molded, one-piece manifold base on which the air compressor and the valve mechanism are mounted, the manifold base including a plenum formed inside the base during molding of the base and a connector component formed during molding of the base for releasably securing the base to the compression device, the plenum fluidly connecting the air compressor to the valve mechanism, the plenum extending through the connector component and fluidly connecting the connector to the valve mechanism so that when the base is secured to the compression device, air can be delivered from the air compressor through the connector component to the compression device, wherein the base has a length, a first face extending along the length of the base, and an opposite second face extending along the length of the base, the connector component extending outward from the first face, the air compressor and the valve mechanism mounted on the second face, the connector component being positioned so that when the portable controller unit is mounted on the compression device the connector component supports the weight of the base, the air compressor and the valve mechanism.

2. A portable controller unit as set forth in claim 1 wherein the connector component is constructed for snap connection to the compression device.

3. A portable controller unit as set forth in claim 2 wherein the connector component has a bulbous shape.

4. A portable controller unit as set forth in claim 3 wherein the plenum extends generally axially through the connector component.

5. A portable controller unit as set forth in claim 2 wherein the base and the connector component are formed of a resilient polymeric material.

6. A portable controller unit as set forth in claim 1 in combination with the compression device, and a mount secured to the compression device for mating with the connector component to releasably secure the portable controller unit to the compression device.

7. A portable controller unit as set forth in claim 1 wherein the connector component has a longitudinal axis that is generally orthogonal to the length of the base.

8. A portable controller unit as set forth in claim 7 wherein the plenum extends through the connector component along the longitudinal axis of the connector component.

9. A portable controller unit as set forth in claim 1 wherein the plenum includes an inlet plenum and an outlet plenum, the inlet plenum extending through the second face of the manifold base in fluid communication with the air compressor at a first location, and through the second face of the manifold base in fluid communication with the valve mechanism at a second location spaced from the first location, the outlet plenum extending through the second face in fluid communication with the valve mechanism at a third location spaced from the first and second locations and through the connector component.

10. A portable controller unit as set forth in claim 6 wherein the compression device has an inner surface and an outer surface, the mount being disposed on the outer surface of the compression device and including a receptacle defining a receptacle opening for receiving the connector component, wherein the receptacle opening extends inward toward the compression device.

11. A portable controller unit as set forth in claim 10 wherein the connector component and the receptacle component are mateable as a snap-fit connection.

12. A method of making a portable controller unit for delivering pressurized air to compression device of the type for applying compression to a body part of a wearer, the method comprising:

molding a one-piece manifold base having a length, a first face extending along the length, an opposite second face extending along the length, a connector component extending outward from the first face for releasably securing the base to the compression device, and a plenum inside the base and extending through the connector component;

mounting an air compressor on the second face of the base adapted for fluid communication with the plenum;

mounting a valve mechanism on the second face of the base adapted for fluid communication with the plenum.

13. A method as set forth in claim 12 wherein the plenum includes an inlet plenum and an outlet plenum, the outlet plenum extending through the connector component, wherein said mounting an air compressor includes mounting the air compressor for fluid communication with the inlet plenum, wherein said mounting a valve mechanism includes mounting the valve mechanism for fluid communication with the inlet plenum downstream of the air compressor and for fluid communication with the outlet plenum upstream of the connector component.

14. A method as set forth in claim 13 wherein the connector component is a male snap connector component.

15. A method as set forth in claim 13 wherein the outlet plenum extends through the connector component along an axis extending generally orthogonal to a longitudinal axis of the base.

16. A method as set forth in claim 12 wherein the plenum includes an inlet plenum and an outlet plenum, the inlet plenum extending through the second face of the manifold base at a first location and through the second face of the manifold base at a second location spaced from the first location, the outlet plenum extending through the second face at a third location spaced from the first and second locations and through the connector component, wherein said mounting an air compressor includes mounting the air compressor for fluid communication with the inlet plenum at the first location on the first face of the manifold base, wherein said mounting a valve mechanism includes mounting the valve mechanism for fluid communication with the inlet plenum at the second location on the first face of the manifold base and for fluid communication with the outlet plenum at the third location on the second face of the manifold base.

* * * * *